US009222736B2

(12) United States Patent
Vatistas et al.

(10) Patent No.: US 9,222,736 B2
(45) Date of Patent: Dec. 29, 2015

(54) HEAT-EXCHANGER CONFIGURATION

(75) Inventors: Georgios H. Vatistas, Laval (CA); Mohamed Fayed, Montreal (CA)

(73) Assignee: VALORBEC SOCIETE EN COMMANDITE, REPRESENTEE PAR GESTION VALEO S.E.C. (CA)

( * ) Notice: Subject to any disclaimer, the term of this patent is extended or adjusted under 35 U.S.C. 154(b) by 873 days.

(21) Appl. No.: 13/380,157

(22) PCT Filed: Jun. 23, 2010

(86) PCT No.: PCT/CA2010/000990

§ 371 (c)(1), (2), (4) Date: Apr. 11, 2012

(87) PCT Pub. No.: WO2010/148515

PCT Pub. Date: Dec. 29, 2010

(65) Prior Publication Data

US 2012/0186794 A1 Jul. 26, 2012

Related U.S. Application Data

(60) Provisional application No. 61/219,801, filed on Jun. 24, 2009.

(51) Int. Cl.

| | |
|---|---|
| ***F28F 3/00*** | (2006.01) |
| ***F28F 13/12*** | (2006.01) |
| ***F28D 9/00*** | (2006.01) |

(Continued)

(52) U.S. Cl.

CPC ..... *F28F 13/12* (2013.01); *F28D 9/0012* (2013.01); *F28D 9/0093* (2013.01); *F28F 9/0253* (2013.01)

(58) Field of Classification Search

CPC ..... F28F 3/00; F28F 7/00; F28F 13/06; F28F 13/12; F28F 19/008; F28F 9/0253; F28D 9/00; F28D 9/0012; F28D 9/0093; F25C 1/142; F25C 1/14

USPC ..... 165/164–165, 169, 170

See application file for complete search history.

(56) References Cited

U.S. PATENT DOCUMENTS 840,667 A * 1/1907 Speed et al. ..... 165/167
2,677,942 A * 5/1954 Schott ..... A01J 15/00 366/144

(Continued)

OTHER PUBLICATIONS

International Search Report PCT/CA2010/000990; Dated Oct. 14, 2010.

(Continued)

*Primary Examiner* — Tho V Duong
*Assistant Examiner* — Aaron Isenstadt
(74) *Attorney, Agent, or Firm* — Cantor Colburn LLP

(57) ABSTRACT

A heat exchanger including a first plate and a second plate spaced apart from the first plate that defines a first gap between inner surfaces of the first plate and the second plate in which a first fluid circulates, where a major portion of the first gap is free of obstructions, where a second fluid contacts an outer surface of the first or second plate for heat exchange with the first fluid, where a first peripheral wall on the periphery of the first gap has a curved profile inside the first gap, and at least one inlet is radially positioned with respect to the first gap and injects the first fluid in the gap, and least one outlet is centrally positioned in one of the first and the second plate to enable the first fluid to exit the first gap, where first fluid circulates in a swirling flow in the major portion of the first gap.

13 Claims, 4 Drawing Sheets

(51) Int. Cl.
*F28F 9/02* (2006.01)
*F28F 9/24* (2006.01)

(56) References Cited

U.S. PATENT DOCUMENTS

| | | | | | |
|---|---|---|---|---|---|
| 3,099,315 | A | * | 7/1963 | Loehr | F28F 1/08 165/109.1 |
| 3,602,298 | A | * | 8/1971 | Ciesielski | 165/164 |
| 3,788,393 | A | * | 1/1974 | Plizak | F28F 13/02 165/104.32 |
| 3,854,530 | A | | 12/1974 | Jouet | |
| 3,882,934 | A | | 5/1975 | Knoos et al. | |
| 4,128,125 | A | | 12/1978 | Borjesson | |
| 4,200,734 | A | * | 4/1980 | Muehlenbrock et al. | 528/503 |
| 4,260,015 | A | * | 4/1981 | Tamburini | F28B 1/02 165/110 |
| 4,291,681 | A | | 9/1981 | Berringer | |
| 4,450,896 | A | * | 5/1984 | Opitz | F28C 3/005 165/139 |
| 4,602,674 | A | | 7/1986 | Eriksson | |
| 4,785,878 | A | | 11/1988 | Honkajarvi et al. | |
| 4,883,117 | A | | 11/1989 | Dobbs et al. | |
| 4,993,487 | A | | 2/1991 | Niggemann | |
| 4,997,034 | A | | 3/1991 | Steffen et al. | |
| 5,220,955 | A | | 6/1993 | Stokes | |
| 5,365,400 | A | | 11/1994 | Ashiwake | |
| 5,582,245 | A | * | 12/1996 | Niimi | F28D 9/0012 165/154 |
| 5,787,974 | A | | 8/1998 | Pennington | |
| 5,838,880 | A | * | 11/1998 | Brooks, Jr. | E02D 3/11 126/343.5 A |
| 5,954,124 | A | | 9/1999 | Moribe | |
| 6,085,832 | A | | 7/2000 | Rehberg | |
| 6,152,215 | A | | 11/2000 | Niggemann | |
| 6,241,377 | B1 | * | 6/2001 | Heyde | A23G 1/18 366/147 |
| 6,644,391 | B1 | * | 11/2003 | Fourt | F28D 9/04 165/156 |
| 6,796,370 | B1 | | 9/2004 | Doll | |
| 7,147,036 | B2 | | 12/2006 | Ike | |
| 7,380,403 | B2 | * | 6/2008 | Smah | F25C 1/14 165/94 |
| 8,210,247 | B2 | * | 7/2012 | Blomgren | F28D 9/0012 165/157 |
| 2004/0251011 | A1 | * | 12/2004 | Kudo | F28D 20/00 165/172 |
| 2007/0030655 | A1 | | 2/2007 | Bhatti | |
| 2009/0260788 | A1 | * | 10/2009 | Nitta et al. | 165/175 |

OTHER PUBLICATIONS

Extended European Search Report for corresponding application EP 10 79 1123; Report Dated Dec. 2, 2014, 2014.

* cited by examiner

HEAT-EXCHANGER CONFIGURATION

CROSS-REFERENCE TO RELATED APPLICATION(S)

The present application claims priority on U.S. Patent Application No. 61/219,801, filed on Jun. 24, 2009, and incorporated herein by reference.

FIELD OF THE APPLICATION

The present application pertains to heat exchangers and, more particularly, to a heat-exchanger design for reducing the pressure drop of fluids across the heat exchanger.

BACKGROUND OF THE ART

Heat exchangers are commonly used in order to transfer energy from one fluid to another through a solid surface. Typical heat exchangers feature tubes, ducts or paths (hereinafter tubes) in which a first fluid circulates as a result of action from a pump, pressure source or the like. A second fluid is in contact with an exterior surface of the tube so as to exchange energy with the first fluid circulating in the tubes. The tube may be shaped in a coil, provided with fins or the like, depending on the heat-exchanger configuration (e.g., shell and tube, heat-exchanger coil, radiator, etc.)

One of the issues with such heat exchangers is that the tubes are costly in terms of material and space. Moreover, because of the friction of the first fluid against the surface of the tube, there is a substantial fluid pressure drop in the heat exchanger. Accordingly, a substantial amount of energy is required to maintain a suitable flow of the first fluid in heat exchangers.

SUMMARY OF THE APPLICATION

It is therefore an aim of the present application to provide a heat exchanger that addresses issues associated with the prior art.

Therefore, in accordance with a first embodiment, there is provided a heat exchanger comprising: at least a first plate and a second plate spaced apart from the first plate to define a first gap between inner surfaces of the first plate and of the second plate in which at least a first fluid circulates, with a major portion of the first gap being free of obstructions, with at least a second fluid contacting an outer surface of at least one of the first plate and of the second plate for heat exchange with the first fluid; a first peripheral wall on the periphery of the first gap, the first peripheral wall having a curved profile inside the first gap; at least one inlet radially positioned with respect to the first gap to inject the first fluid in the gap; and at least one outlet centrally positioned in one of the first plate and the second plate, for the first fluid to exit the first gap; whereby the first fluid circulates in a swirling flow in the major portion of the first gap.

Further in accordance with the first embodiment, the first plate is a first disk and the second plate is a second disk having a peripheral outline similar to that of the first disk.

Still further in accordance with the first embodiment, the heat exchanger further comprises at least a third plate spaced apart from the outer surface of any one of the first plate and the second plate to define a second gap with a major portion of the second gap being free of obstructions, a second peripheral wall on the periphery of the second gap having a curved profile inside the second gap, at least one said inlet and at least one said outlet being in fluid communication with the second gap to cause a swirling flow of the second fluid in the second gap.

Still further in accordance with the first embodiment, the first plate forms the first gap with the second plate, and the first plate forms the second gap with the third plate, with a first one of said outlet being a first pipe centrally positioned in the second plate for the first fluid to exit the first gap, and with a second one of said outlet being a second pipe centrally positioned in the third plate for the second fluid to exit the second gap, whereby the first pipe and the second pipe are concentric.

Still further in accordance with the first embodiment, the heat exchanger further comprises at least a fourth plate spaced apart from the second plate to define a third gap with a major portion of the third gap being free of obstructions, a third peripheral wall on the periphery of the third gap having a curved profile inside the third gap, at least one said inlet and at least one said outlet being in fluid communication with the third gap to cause a swirling flow of a fluid in the third gap, with a third one of said outlet being a third pipe centrally positioned in the fourth plate and having a diameter greater than the first pipe to form an annular passage about the first pipe for fluid to exit the third gap, whereby the first pipe and the third pipe are concentric.

Still further in accordance with the first embodiment, the first plate forms the first gap with the second plate, and the second plate forms the second gap with the third plate, with a first one of said outlet being a first pipe centrally positioned in the second plate and passing through the third plate for the first fluid to exit the first gap, and with a second one of said outlet being a second pipe having a diameter greater than the first pipe and being centrally positioned in the third plate to form an annular passage about the first pipe for fluid to exit the second gap, whereby the first pipe and the second pipe are concentric.

Still further in accordance with the first embodiment, at least one radial outlet pipe is connected to any one of the pipes of the outlets centrally positioned in the plates, for exit of fluids therethrough.

Still further in accordance with the first embodiment, vanes extend between surfaces of the spaced apart plates in at least one of the gaps to guide fluids in the swirling flow.

Still further in accordance with the first embodiment, a first set of the vanes are radially distributed and equidistantly spaced from one another and from a center of a respective one of the gaps.

Still further in accordance with the first embodiment, the first set of vanes is adjacent to the at least one peripheral wall.

Still further in accordance with the first embodiment, the heat exchanger further comprises a second set of the vanes, the second set of the vanes being radially distributed and equidistantly spaced from one another and from a center of a respective one of the gaps, the second set being positioned between the first set of the vanes and a center of a respective one of the gaps.

Still further in accordance with the first embodiment, the at least one set of the vanes comprises at least one annular plate integral with the vanes, the annular plate being coplanar with a respective one of the plates when the sets of vanes are in the respective gap.

Still further in accordance with the first embodiment, vanes are at an 80 degree angle from a radius of the gap.

Still further in accordance with the first embodiment, the curved profile of the at least one peripheral wall is substantially circular.

Still further in accordance with the first embodiment, the at least one inlet is tangentially oriented with respect to the curved profile of the at least one gap.

Still further in accordance with the first embodiment, the heat exchanger comprises at least two of the inlet for at least one of the gaps.

DESCRIPTION OF PREFERRED EMBODIMENTS

Figure 1:
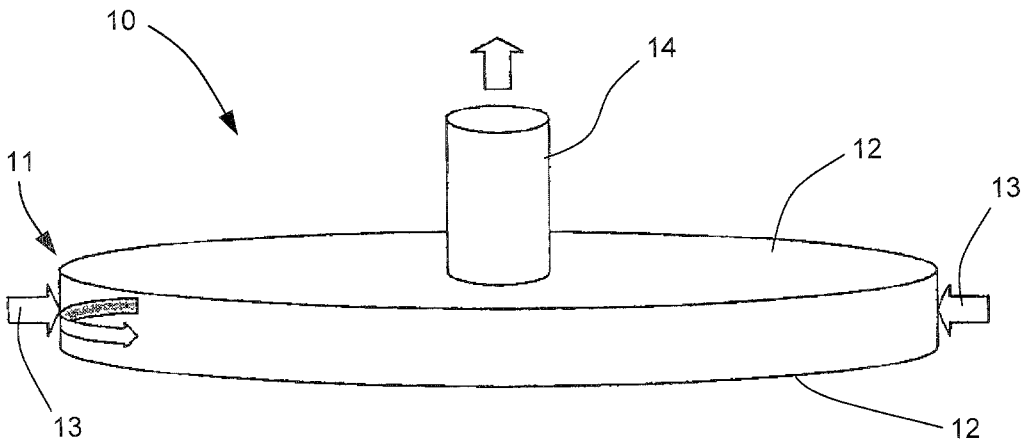
FIG. 1 is a schematic perspective view of a heat exchanger in accordance with the embodiment of the present application.

Referring to the drawings and, more particularly to FIG. 1, a heat exchanger in accordance with the present disclosure is generally shown at 10. The heat exchanger 10 of FIG. 1 is a disk-type heat exchanger in which circulates a fluid or combination of fluids, fluid and solid (i.e., liquid and/or gas, with solids in suspension). Another fluid, combination of fluid/solid or fluids is in contact with an exterior surface of the heat exchanger 10. For simplicity purposes, reference will be made to fluids hereinafter. The heat exchanger 10 of FIG. 1 is therefore said to have a single stage 11.

The heat exchanger 10 of FIG. 1 has a pair of disks 12. Typically, the disks 12 are circular in shape, although other shapes are considered, preferably with rounded or arcuate peripheries. The disks 12 are spaced apart, so as to define a gap therebetween, in which the fluid will flow. A peripheral wall bounds the gap between the disks 12, and inlets 13 (i.e., one or more) are provided in this peripheral wall or in the disks 12, for the injection of fluid into the gap. The peripheral wall 13 has a curved inner profile to define the curved inner periphery of the gap. In an embodiment, the curved inner profile of the peripheral wall 13 is circular. As a radial periphery of the gap in which the fluid circulates is defined by the peripheral wall 13, the disks may be replaced by plates or walls of different shapes, etc.

A central outlet 14 projects upwardly from one of the disks 12, although both disks 12 may be provided with a central outlet 14. As the inlet(s) 13 are provided on the periphery of the heat exchanger 10, and the outlet 14 is centrally positioned, the fluid injected into the gap exits centrally. However, it is desired to have the fluid flow in a swirling pattern. Therefore, when fluid is injected into the inlets 13, the inlets 13 may be oriented so as to give a generally tangential direction, to cause a swirling pattern of the fluid in the gap. Due to the area reduction, the fluid is accelerated (i.e., accelerating flow or in-sink flow). Accordingly, the fluid in the heat exchanger 10 adopts the swirling pattern and remains between the disks 12 until it exits through the central outlet 14. It is observed that the gap between the disks 12 is generally free of obstructions.

While the fluid swirls to the central outlet 14, the fluid contacts the inner surfaces of the disks 12 in the gap, thereby exchanging heat with fluid on the outside of the disks 12. The residence time of the fluid in the stage 11 may be controlled by adjusting the flow of the fluid in the stage 11, for instance by adjusting the intensity of the pump(s) whether upstream or downstream of the heat exchanger 10.

Figure 2:
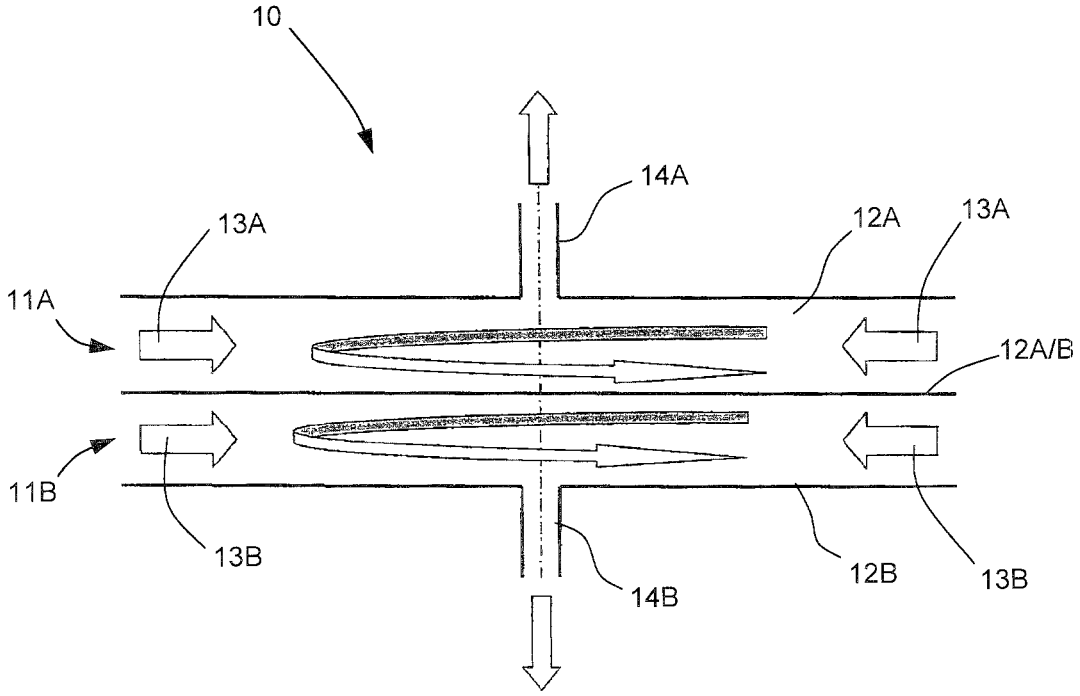
FIG. 2 is a sectional schematic view of the heat exchanger of FIG. 1, with two stages.

Referring to FIG. 2, a configuration similar to that of the heat exchanger 10 of FIG. 1 is illustrated, but with two stages 11. Accordingly, a first fluid circulates in stage 11A, whereas a second fluid circulates in stage 11B. For clarity purposes, the components of the stage 11A have been affixed with the letter A, whereas the components of stage 11B have been affixed with the letter B. Therefore, in the case of FIG. 2, two fluids are in heat exchange using the heat-exchanger configuration 10 of FIG. 1, through common disk 12A/B. One of the fluid absorbs heat released by the other fluid. The disk 12A/B is made of a material preferably having high heat conductivity, such as metal (e.g., aluminum). Throughout the description, the nomenclature using affixed letters separated by a slash (e.g., 12A/B) will refer to a disk separating two stages (A and B). Coatings may be added to the surfaces of the disks to minimize the friction of fluids against the surfaces of the disks.

Figure 3:
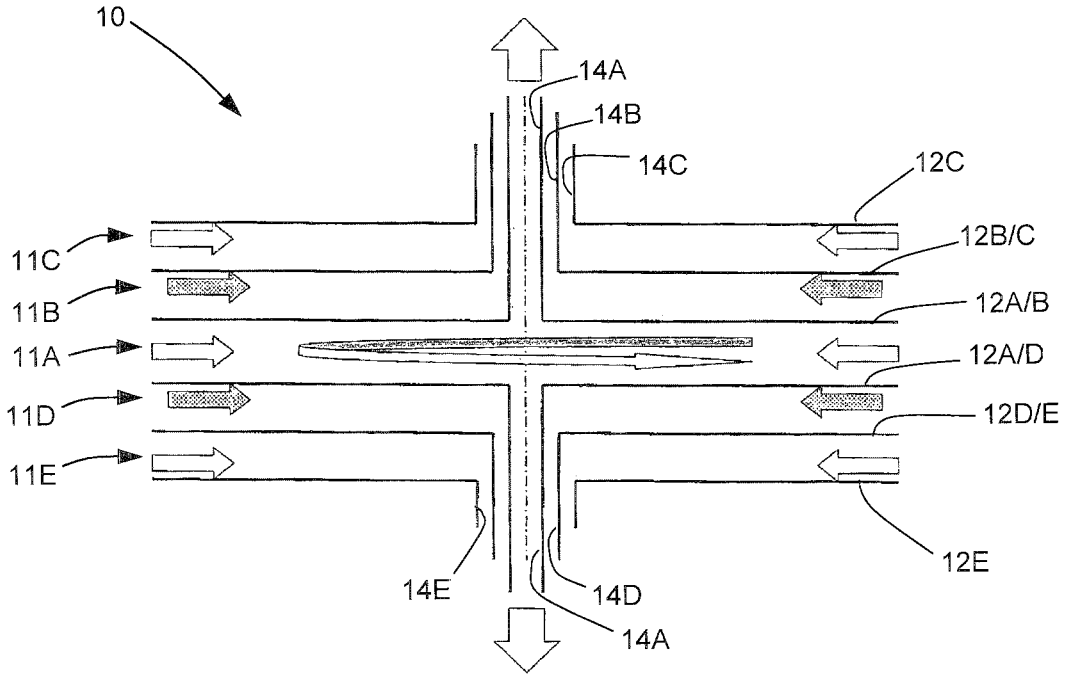
FIG. 3 is a schematic sectional view of the heat exchanger of FIG. 1 with five stages.

Referring to FIG. 3, the heat exchanger 10 is shown having a multi-disk configuration having five different stages, namely stages 11A, 11B, 11C, 11D and 11E. Accordingly, five different fluids may flow in the separate stages of the heat exchanger 10. Alternatively, some of the stages are combined as different passes for a same fluid, or parallel stages for a same fluid. As an example, a first fluid may circulate in stages 11A, 11C and 11E, while a second fluid circulates in stages 11B and 11C. As another example, the fluid collected at the outlets 14A may be subsequently circulated in stages 11C and 11E, amongst other possibilities. It is observed that stage 11A may have a pair of central outlets 14A, as illustrated. Moreover, the outlets of stages 11B, 11C, 11D and 11E are concentrically positioned with respect to the central outlet 14A, with the outlets 14 of stages 11B-11D forming annular geometries.

Figure 4:
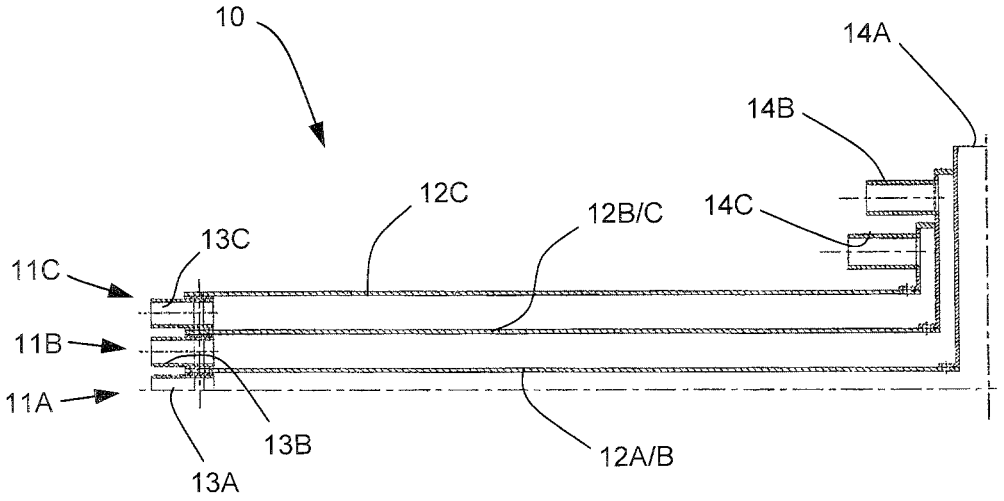
FIG. 4 is a sectional view of a portion of the heat exchanger of FIG. 3.

Referring to FIG. 4, a sectional view of the heat exchanger 10 of FIG. 3 is illustrated, showing that the outlets 14B and 14C may comprise outlet pipes projecting radially from the annular central outlets 14B and 14C, although various other configurations may be used as well.

Figure 5:
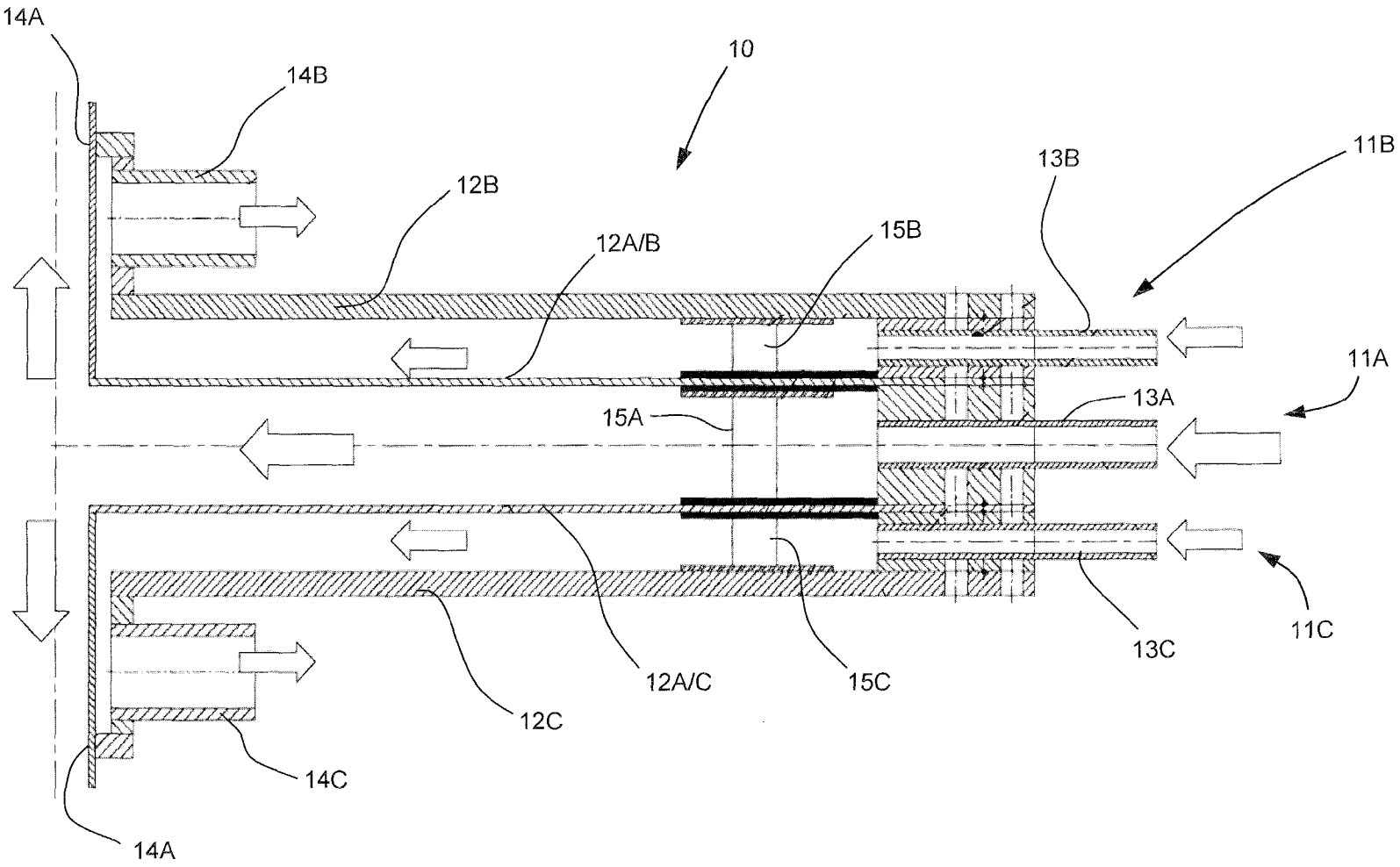
FIG. 5 is a side elevation view of the heat exchanger of FIG. 1 with three stages.
Figure 6:
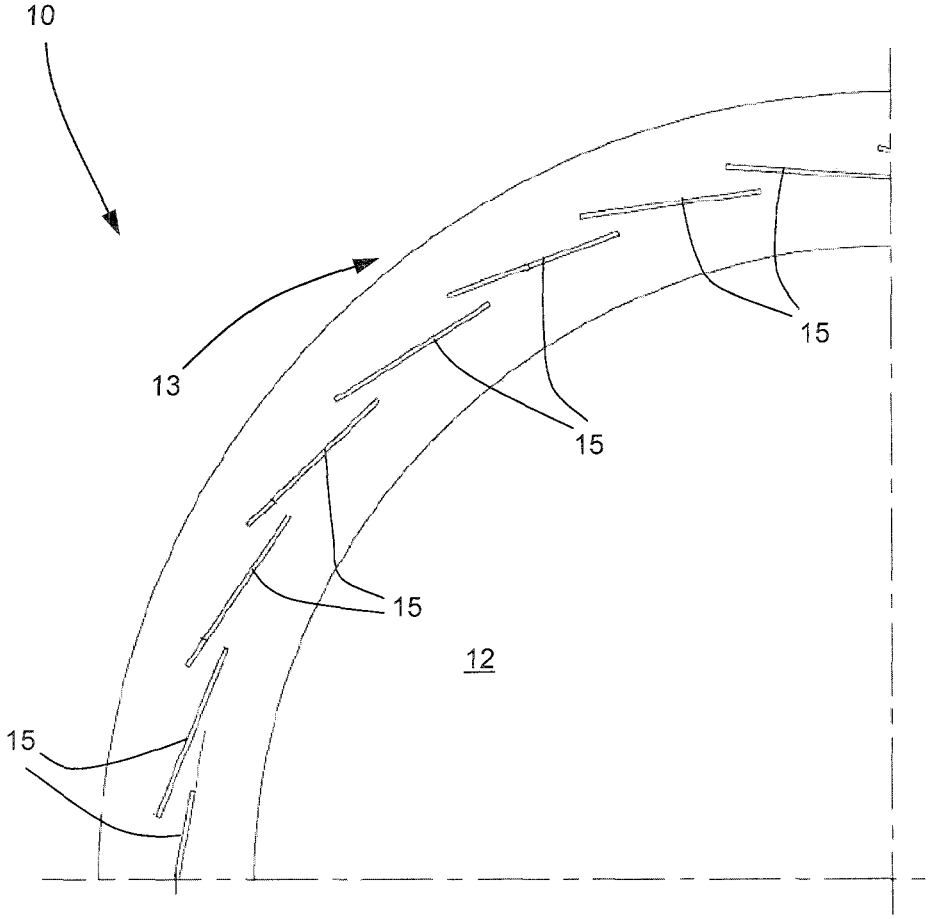
FIG. 6 is a plan view of an interior of the heat exchanger of FIG. 1 in accordance with another embodiment of the present application.

Referring concurrently to FIGS. 5 and 6, another embodiment of the heat exchanger 10 is illustrated, with vanes 15 provided in the gap between disks 12 (i.e., vanes 15A-15C for stages 11A-11C in FIG. 5). More specifically, the vanes 15 are provided adjacent to the peripheral wall and thus adjacent to the inlets 13. The vanes 15 are narrow rigid plates used to guide the flow of fluid in adopting a swirling pattern in the gap. A leading edge of each vane 15 is closer to the periphery than the trailing edge of the adjacent vane 15. Other devices or deflectors may be used to guide the flow of fluid into the swirling pattern. According to an embodiment, the vanes 15 are radially arranged, and may be equidistantly spaced from a center of the gap and from one another.

In an embodiment, the vanes 15 are provided on a ring plate (i.e., annular plate) coplanar disposed on one of the disks, as shown in FIGS. 5 and 6. Accordingly, all vanes 15 are installed/removed by the simple manipulation of the ring plate (e.g., plexiglass). Another similar ring plate with vanes 15 may be provided with a smaller diameter and hence be closer to the center of the heat exchanger 10. In an example, the vanes are at an 80 degree angle from a radius of the gap between the disks 12. Other materials may be used as well (e.g., mesh).

Despite the presence of vanes 15, a major portion of the gap is free of obstructions, whereby the fluid adopts a swirling pattern without a spiral-type conduit in the gaps, resulting in relatively low friction.

The heat exchanger 10 of FIGS. 1 to 6 is also relatively simple to maintain, as the disks 12 may readily be separated from one another for maintenance. As is shown in FIGS. 4 and 5, the inlets 13 and peripheral wall may be one integral piece interconnecting the disks 12. The applications using the heat exchanger 10 may range from domestic heating systems, to steam power plants, to refineries, amongst numerous possibilities.

The invention claimed is:

1. A heat exchanger comprising:

a first plate and a second plate spaced apart from and parallel to the first plate to define a first gap between inner surfaces of the first plate and of the second plate in which at least a first fluid circulates, with a major portion of the first gap being free of obstructions;

a first peripheral wall on the periphery of the first gap, the first peripheral wall having a curved profile inside the first gap, only one cavity being defined between a total volume bound by the first peripheral wall, the inner surface of the first plate and the inner surface of the second plate;

at least one inlet circumferentially positioned with respect to the only one cavity and in fluid communication with the only one cavity to inject the first fluid in the only one cavity;

at least one outlet centrally positioned in the second plate and in fluid communication with the only one cavity, for the first fluid or first fluid combination to exit the only one cavity, the at least one outlet being a first pipe centrally positioned in the second plate for the first fluid to exit the first gap whereby the first fluid or first fluid combination circulates in a swirling flow in the major portion of the only one cavity;

at least a third plate spaced apart from the outer surface of the first plate to define a second gap in which at least a second fluid circulates, with a major portion of the second gap being free of obstructions the second fluid contacting the outer surface of the first plate for heat exchange with the first fluid or first fluid combination;

a second peripheral wall on the periphery of the second gap having a curved profile inside the second gap; and at least one other inlet and at least one other outlet being in fluid communication with the second gap to inject the second fluid in the second gap and to cause a swirling flow of the second fluid in the second gap, said other outlet being a second pipe centrally positioned in the third plate for the second fluid to exit the second gap, whereby the first pipe and the second pipe are concentric.

2. The heat exchanger according to claim 1, wherein the first plate is a first disk and the second plate is a second disk having a peripheral outline similar to that of the first disk.

3. The exchanger according to claim 1, further comprising at least a fourth plate spaced apart from the second plate to define a third gap with a major portion of the third gap being free of obstructions, a third peripheral wall on the periphery of the third gap having a curved profile inside the third gap, at least one said inlet and at least one said outlet being in fluid communication with the third gap to cause a swirling flow of a fluid in the third gap, with a third one of said outlet being a third pipe centrally positioned in the fourth plate and having a diameter greater than the first pipe to form an annular passage about the first pipe for fluid to exit the third gap, whereby the first pipe and the third pipe are concentric.

4. The heat exchanger according to claim 1, further comprising at least one radial outlet pipe connected to any one of the pipes of the outlets centrally positioned in the plates, for exit of fluids therethrough.

5. The heat exchanger according to claim 1, further comprising vanes extending between surfaces of the spaced apart plates in at least one of the gaps to guide fluids in the swirling flow.

6. The heat exchanger according to claim 5, wherein a first set of the vanes are circumferentially distributed and equidistantly spaced from one another and from a center of a respective one of the gaps.

7. The heat exchanger according to claim 6, wherein the first set of vanes is adjacent to the at least one peripheral wall.

8. The heat exchanger according to claim 7, further comprising a second set of the vanes, the second set of the vanes being radially distributed and equidistantly spaced from one another and from a center of a respective one of the gaps, the second set being positioned between the first set of the vanes and a center of a respective one of the gaps.

9. The heat exchanger according to claim 6, wherein the at least one set of the vanes comprises at least one annular plate integral with the vanes, the annular plate being coplanar with a respective one of the plates when the sets of vanes are in the respective gap.

10. The heat exchanger according to claim 5, wherein vanes are at an 80 degree angle from a radius of the gap.

11. The heat exchanger according to claim 1, wherein the curved profile of the at least one peripheral wall is substantially circular.

12. The heat exchanger according to claim 1, wherein the at least one inlet is tangentially oriented with respect to the curved profile of the at least one gap.

13. The heat exchanger according to claim 1, comprising at least two of the inlet for at least one of the gaps.

* * * * *